US005704472A

United States Patent [19]

Werner et al.

[11] Patent Number: 5,704,472

[45] Date of Patent: Jan. 6, 1998

[54] PHOTO HOLDER FOR ADVANCED PHOTO SYSTEM

[75] Inventors: Richard S. Werner, 326 Cedar Sauk Rd., West Bend, Wis. 53095; Al Sitter, Racine, Wis.; Steve Kruchten, Franksville, Wis.

[73] Assignee: Richard S. Werner, West Bend, Wis.

[21] Appl. No.: 605,970

[22] Filed: Feb. 23, 1996

[51] Int. Cl.[6] ..... B65D 85/67

[52] U.S. Cl. ..... 206/232; 206/455

[58] Field of Search ..... 206/578, 232, 206/425, 449, 454, 455, 223

[56] References Cited

U.S. PATENT DOCUMENTS

| | | | |
|---|---|---|---|
| 5,251,746 | 10/1993 | Gresh et al. | 206/455 X |
| 5,263,579 | 11/1993 | Blackman | 206/455 X |
| 5,303,825 | 4/1994 | Hansen et al. | 206/455 X |

*Primary Examiner*—Jacob K. Ackun
*Attorney, Agent, or Firm*—Jansson & Shupe, Ltd.

[57] ABSTRACT

A photo/photo cartridge delivery/storage packet for the products of Advanced Photo Systems (APS) processing, comprising a first and second sheet-like cover members disposed in spaced, substantially parallel planes and each having a spine-adjacent edge, a sheet-like spine interconnecting the cover members along said spine-adjacent edges, a plurality of sheet-like photos interposed between the cover members and removably/replaceably secured to the spine by adhesive, and a means on the second cover member for securing thereto the APS photo cartridge associated with said photos. In the most preferred embodiment, the free edge of the second cover member of the packet extends past the free edge of the first cover member thereby forming a cover extension. The APS photo cartridge can be secured to either surface of the second cover member in a variety of ways that allow the cartridge to remain on the cover or be removed for storage elsewhere while the cover extension is used as a locking flap.

46 Claims, 14 Drawing Sheets

PHOTO HOLDER FOR ADVANCED PHOTO SYSTEM

FIELD OF THE INVENTION

This invention relates to the storing and protection of developed film and printed photographs in general, and more specifically, to film developed and photographs printed using the Advanced Photo System.

BACKGROUND OF THE INVENTION

The Advanced Photo System ("APS") is a new process related to the field of photography. With the APS, information regarding the film speed, emulsion details and photograph length will be magnetically recorded on the film. When a photograph is being taken, the camera reads the information on the film and can then automatically add exposure information in order to correct for lighting errors. These corrections result in better photo-finishing.

Using the APS, a photographer will be able to preselect the size of his finished photographic print prior to the taking of a picture. This feature will allow an individual to take pictures of various sizes using the same role of film.

Because print information is digitized on to the film, the developed film will remain in the original film canister. Because the consumer will no longer be receiving the familiar film strips, commonly called "negatives," they will be provided with an index card—much like a proof sheet—along with their printed photographs. The index card will show miniversions of all of the pictures on a particular role of film. Because the developed film will be returned in its original canister, a new device is needed that will allow the consumer to store the printed photographs and film canister together.

Conventional methods of storing developed film and photographic prints have involved the use of photo albums comprised of loose-leaf transparent film storing sheets equipped with a number of small pockets. These pockets are sized such that a printed photograph can be inserted into each one. Developed film or negatives, are stored in similar pockets that are sized to accommodate the pre-cut strips of exposed film. These pages are usually bound together by the use of some mechanical retainer such as a three-ring binder.

Another photo storage methods is disclosed in U.S. Pat. No. 5,040,216 (Policht). This method involves taping edge of a photograph to a binder member having a two adhesive-coated strip attached to it. The binder members are then bound together by the use of retainers located at opposite end of the album's spine. Negative sheets are stored in a pocket located in one of the album's covers. A major drawback of this device is that it will not allow for the storage of the film cartridge used by the APS. An additional drawback is that only photographs of the same size can be conveniently stored in the same album.

U.S. Pat. No. 5,431,449 (Arimoto et al.) discloses a film storing sheet that provides for the storage of an index print on which recorded images on a developed film are printed. The Arimoto patent also uses a film sheet having a plurality of small pockets to store the developed film.

As with other patents involving photo albums, the major drawback associated with the Arimoto patent is that it does not permit the combined storage of the APS photo cartridge, the index print, and the printed photographs.

There are a number of drawbacks and shortcomings associated with various arrangements and devices in the prior art. This invention relates to a unique solution, and a variety of preferred solutions to such problems. A photo-storage package that allows for the combined storage of the APS photo cartridge, the index print, and printed photographs of various sizes would be an important advancement in the art.

OBJECTS OF THE INVENTION

An object of the invention is to provide a photo/photo-cartridge delivery/storage packet that overcomes some of the problems and shortcomings of the prior art.

An object of the invention is to provide a photo/photo-cartridge delivery/storage packet that allows for the combined storage of the APS film cartridge, index print, and printed photographs.

Another object of the invention is to provide an original sale package for the APS film cartridge that allows for the storage of the processed film and printed photographs.

Yet another object of the invention is to provide a photo/photo-cartridge delivery/storage packet that provides the capability for attaching to the package, the original retail package of the APS film cartridge or parts thereof.

Still another object of the invention is to provide a photo/photo-cartridge delivery/storage packet that provides a separate storage container for the APS film cartridge, either by itself or in combination with the index print, that can be stored on a separate surface.

Another object of the invention is to provide a photo/photo-cartridge delivery/storage packet that allows for the storage of printed photographs of various sizes that are produced using the APS process.

Still another object of the invention is to provide a photo/photo-cartridge delivery/storage packet that allows for the easy removal and replacement of the printed photographs produced using the APS process.

Yet another object of the invention is to provide a photo/photo-cartridge delivery/storage packet that allows for the storage of printed photographs of various sizes separate from the APS film cartridge along with the index print.

Another object of the invention is to provide a photo/photo-cartridge delivery/storage packet for the APS that can be hung from a retail display.

Still another object of the invention is to provide a photo/photo-cartridge delivery/storage packet for the APS that allows for easy removal and replacement of the APS film cartridge.

Still another object of the invention is to provide a photo/photo-cartridge delivery/storage packet that allows the container housing the APS film cartridge to be stored on another surface.

Another object of the invention is to provide a photo/photo-cartridge delivery/storage packet for the APS that doubles as a photo album.

SUMMARY OF THE INVENTION

The invention involves a photo/photo cartridge delivery/storage packet for the products of Advanced Photo Systems (APS) processing. Such invention includes a first and second sheet-like cover members disposed in spaced in such a way that the cover members lie in substantially parallel planes with each cover member having a spine-adjacent edge. A sheet-like spine joins the cover members together by interconnecting with each of them along their spine-adjacent edges. A plurality of sheet-like photos are interposed between the cover members and removably/replaceably secured to the spine by adhesive, and a means is provided on the second cover member for securing thereto the APS photo cartridge associated with the photos. The invention also includes an APS index print which is attached to the inside of one of the cover members.

In a preferred embodiment of the invention, the second cover member has a transverse scored line that facilitates a crease in the second cover. This scored line which involves a substantially continuous partial-depth surface cutting, perforation, or indentation, is at a distance from the spine-adjacent edge of the second cover member which is substantially equal to the distance between the spine-adjacent and free edges of the first cover member, whereby the scored line is parallel and adjacent to the free edge of the first cover member. In yet another preferred embodiment, the second cover member includes an opening which is used to facilitate the hanging of the device on a rod.

The invention secures the APS photo cartridge to the packet by the use of a container member and adhesive between the container member and the second cover member. In a preferred embodiment, a double-stick tape is used to provide the adhesive, thereby facilitating attachment of the container member during assembly of the packet. In a highly preferred embodiment, the double-stick tape has adhesive of higher adhesiveness on one side than on the other. This differential in adhesiveness determines whether or not the double-stick tape will be removed from the second cover member upon removal of the container member.

In yet another highly preferred embodiment, the higher-adhesiveness side of the double-stick tape is adhering to the container member, thereby facilitating removal of the container member from the second cover member in a manner allow ready attachment to a storage surface.

In a preferred embodiment of the invention, the container member used to secure the APS photo cartridge to the packet comprises a blister member, whereby a portion of the second cover member and the blister member together form a blister pack providing a container for the cartridge. In this embodiment, the blister member includes opposed first and second edge portions which adhere to the second cover member. In a highly preferred embodiment, the adhesive includes adhesive of higher adhesiveness along the first edge portion, and adhesive of lower adhesiveness along the second edge portion such that the first edge portion functions as a hinge when only the first edge portion is adhering to the second cover member, thereby facilitating the opening and closing of the container for removal and reinsertion of the cartridge.

In yet another embodiment of the invention, the container member used to secure the APS photo cartridge to the packet involves the use of a pouch. In still yet another embodiment, the pouch is of a substantially transparent material.

In a very highly preferred embodiment of the invention, each cover member has a free edge opposite its spine-adjacent edge and the free edge of the second cover member is farther from its spine-adjacent edge than is the free edge of the first cover member from its spine-adjacent edge, thereby forming a cover extension. In this embodiment, the cover extension provides the surface to which the APS photo cartridge is secured by use of the various techniques described above.

In yet another highly preferred embodiment, the adhesive and the surfaces of the cover extension and container member that the adhesive joins together are such that the removal of the container member leaves the adhesive on the cover extension. This allows for the cover extension to be used as a flap to fold over the free edge of the first cover member and adhere thereto or to fold back onto and adhere to the second cover member. In a more specific version of such embodiment, the cover extension is narrower than the remainder of the second cover member.

In still another highly preferred embodiment of this invention, the cover extension and the first cover member each have an inner surface and an outer surface, the container member is secured to the outer surface of the cover extension, and a fastening means is secured to the inner surface of the cover extension and to the outer surface of the first cover member whereby the inner surface of the cover extension is attached against the outer surface of the first cover member. In an additional version of this embodiment, the container member is secured to the inner surface of the cover extension, and a fastening means is secured to the inner surface of the cover extension and to the outer surface of the first cover member.

In a specific version of this embodiment, the fastening means comprises interconnecting hook and loop surfaces. In a more specific version of this embodiment, the fastening means comprises double-stick tape. In still another version of the embodiment, the fastening means comprises magnetic tape, while in yet another version of the embodiment, the fastening means comprises an interconnecting slot-and-tab arrangement.

In another version of the very highly preferred embodiment of the invention, the securing means comprises a card member, a container member attached to the card member to form a container for the cartridge, and an adhesive between the container and the cover extension. In this embodiment, the adhesive comprises double-stick tape between the card member and cover extension, and the container member comprises a blister member, whereby the container is a blister pack formed of the card member and the blister member together.

In a more specific embodiment, the blister member includes opposed first and second edge portions which adhere to the card member. And, in yet another more specific embodiment, a second adhesive and a third adhesive secure the first and second edge portions, respectively, to the card member. In this embodiment, the second adhesive has a higher adhesiveness than the third adhesive such that the first edge portion functions as a hinge when only the first edge portion is adhering to the card member, thereby facilitating opening and closing of the container for removal and reinsertion of the cartridge.

DETAILED DESCRIPTION OF THE PREFERRED EMBODIMENTS

Figure 1:
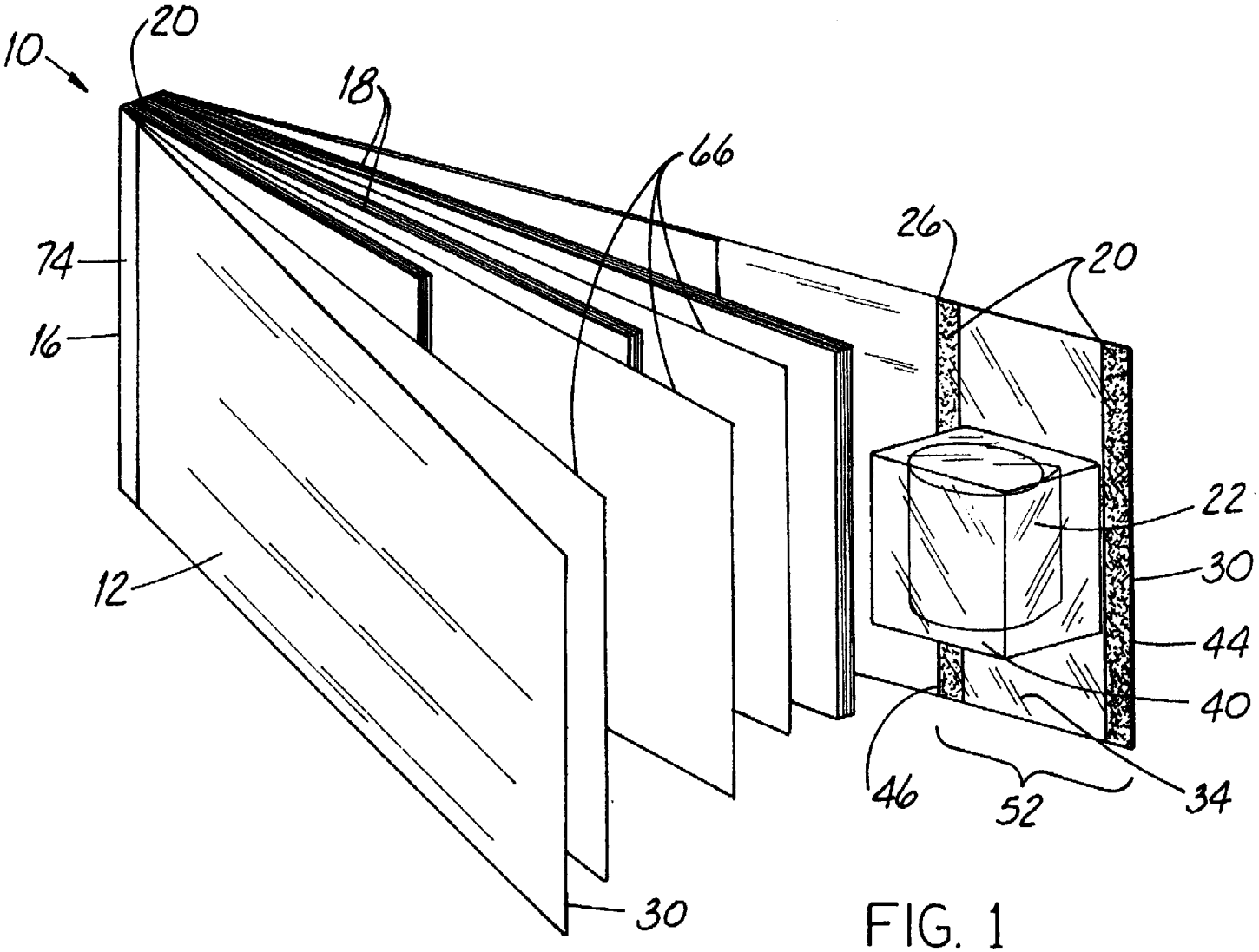
FIG. 1 a perspective view of the photo/photo cartridge delivery/storage packet for the Advanced Photo System showing photos of various lengths and the APS film cartage secured to the cover extension.

FIGS. 1–12, 14, 19 and 20, show a photo/photo cartridge delivery/storage packet 10 for the products of Advanced Photo Systems (APS) processing. Such a packet includes a first and second sheet-like cover members 12, 14 disposed in spaced in such a way that the cover members 14, 16 lie in substantially parallel planes with each cover member 14, 16 having a spine-adjacent edge 16. A sheet-like spine 74 joins the cover members together by interconnecting with each them along their spine-adjacent edges 16. A plurality of sheet-like photos 18 are interposed between the cover members 14, 16 and removably/replaceably secured to the spine 74 by adhesive 20. These photos 18 may be of the same or various lengths. When photos 18 of differing lengths are secured to the spine 74, dividers 66 are used to separate the various sizes. The packet 10 also includes a means on the second cover member 14 for securing thereto the APS photo cartridge 22 associated with the photos 18 as well as an attachment on the inside of one of the covers for storing an APS index print 24.

Figure 2:
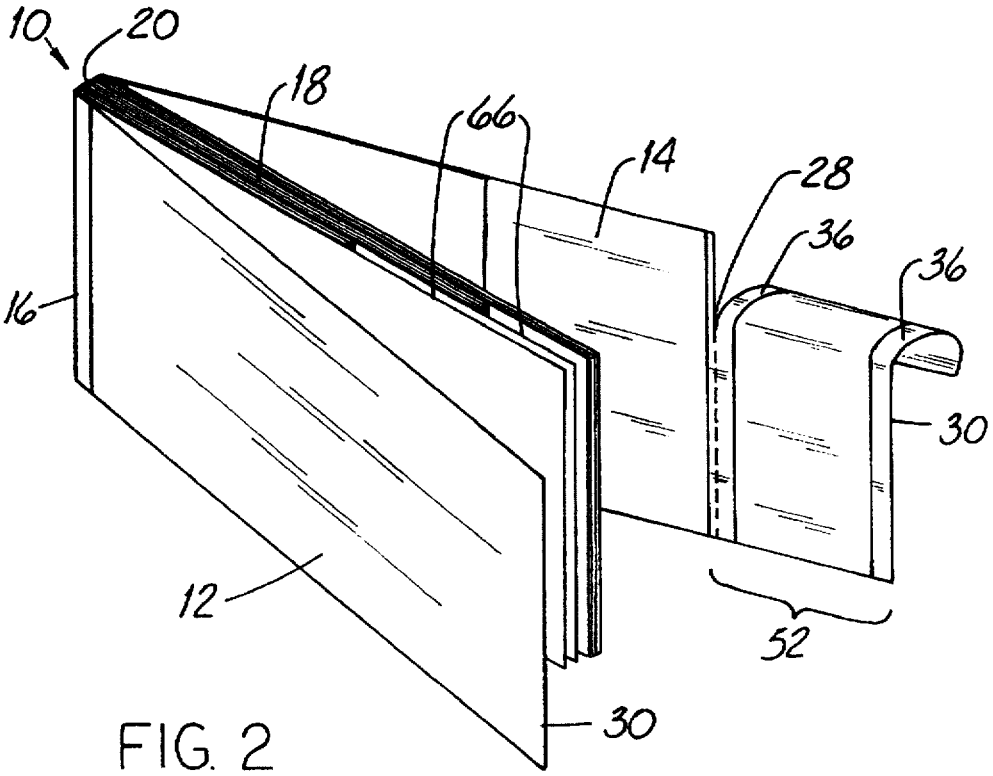
FIG. 2 is a perspective view of the photo/photo cartridge delivery/ storage packet for the Advanced Photo System showing a perforated scoring demarcation line located between the cover and the cover extension and reinforced with double-stick tape.

FIG. 1, shows a preferred embodiment of the invention, in which the second cover member 14 has a transverse scored line 26 that is used to facilitate a crease in the second cover. This scored line which involves a substantially continuous partial-depth surface cutting, indentation, or perforation 28, as shown in FIG. 2, is at a distance from the spine-adjacent edge 16 of the second cover member 14 which is substantially equal to the distance between the spine-adjacent 16 and free edges 30 of the first cover member 12, whereby the scored line 26 is parallel and adjacent to the free edge 30 of the first cover member 12. In a highly preferred embodiment, the perforation 28 is reinforced by a strip of double-stick tape 36 that does not interfere with the tearing along the perforation 28; it has been found that an appropriate choice of tape 36 will prevent accidental weakening and detachment while having no negative effect on deliberate tearing.

Figure 7:
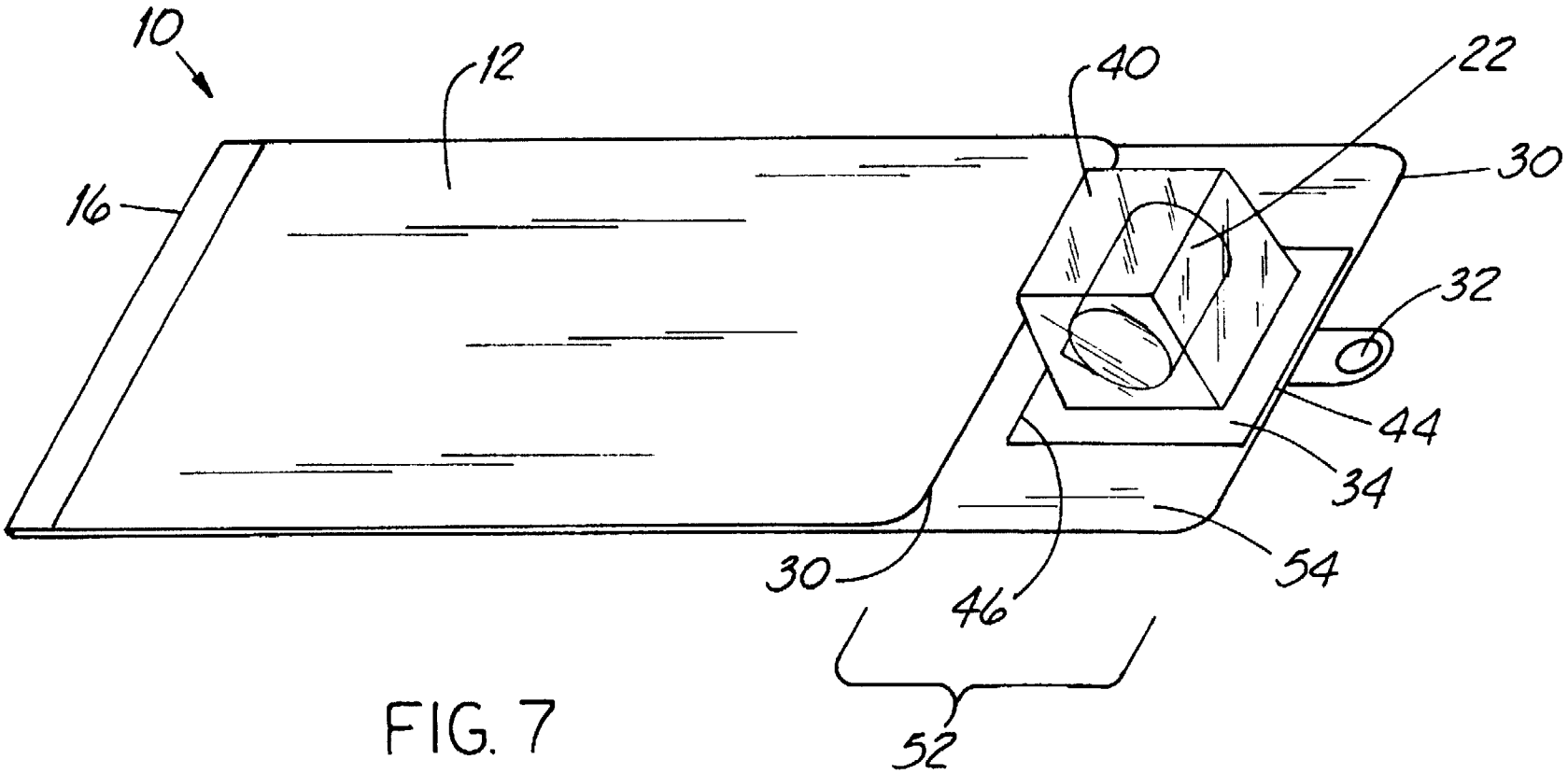
FIG. 7 is a perspective view of the photo/photo cartridge delivery/storage packet for the Advanced Photo System showing an attachment that allows the packet to be hung on a display or storage rod.

FIG. 7, shows yet another preferred embodiment, in which the second cover member 14 includes an opening 32 which is used to facilitate the hanging of the packet 10 on a rod.

Figure 19:
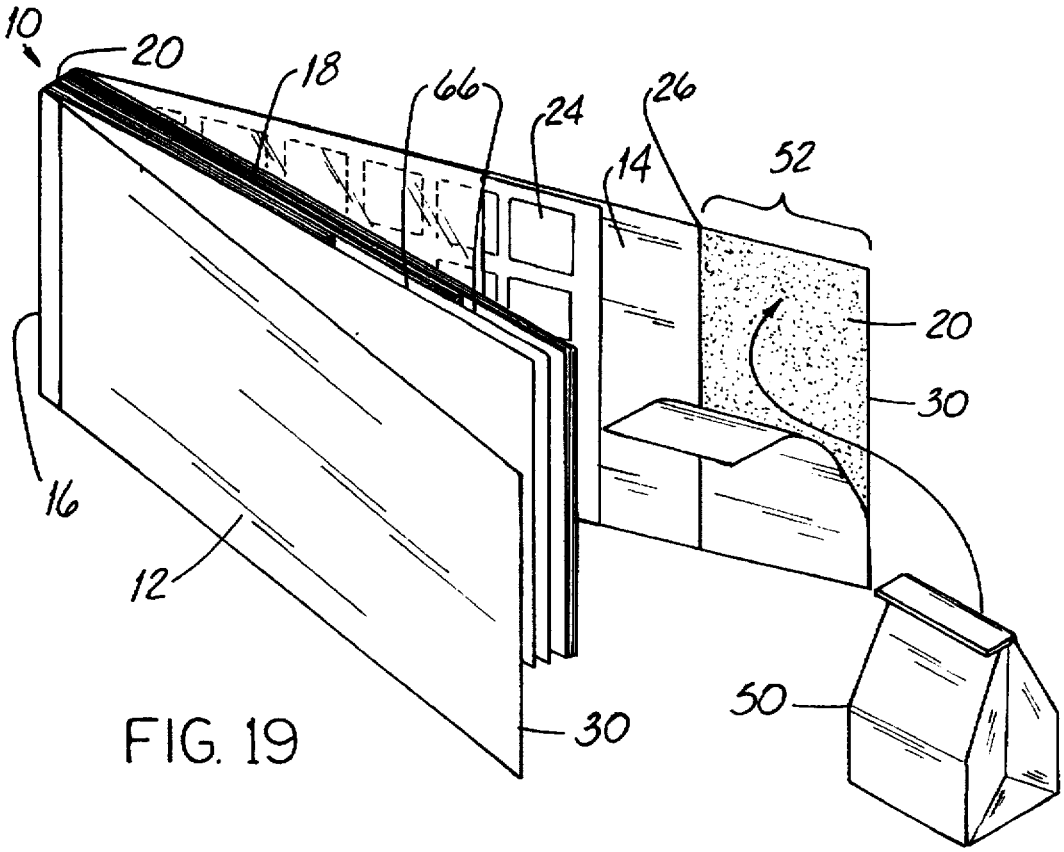
FIG. 19 is a perspective view of the photo/photo cartridge delivery/storage packet for the Advanced Photo System showing and index print inserted in the packet, and double-stick tape attached to the cover extension for the securing of the APS pouch.
Figure 5:
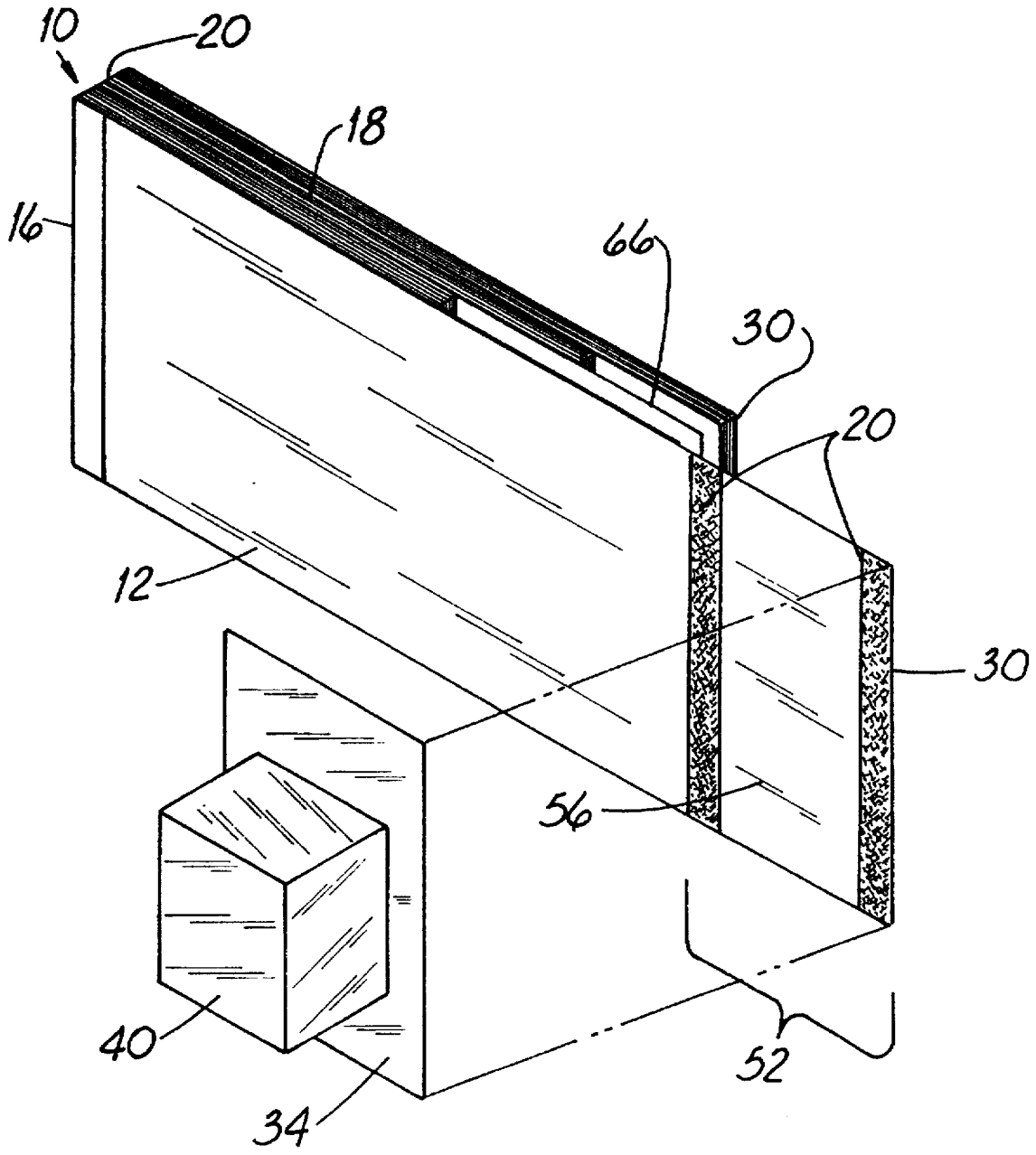
FIG. 5 is a perspective view of the photo/photo cartridge delivery/storage packet for the Advanced Photo System showing a blister member attached to the first side of the cover extension where the double-stick tape remains attached to the cover extension when the blister member is removed from the cover.
Figure 6:
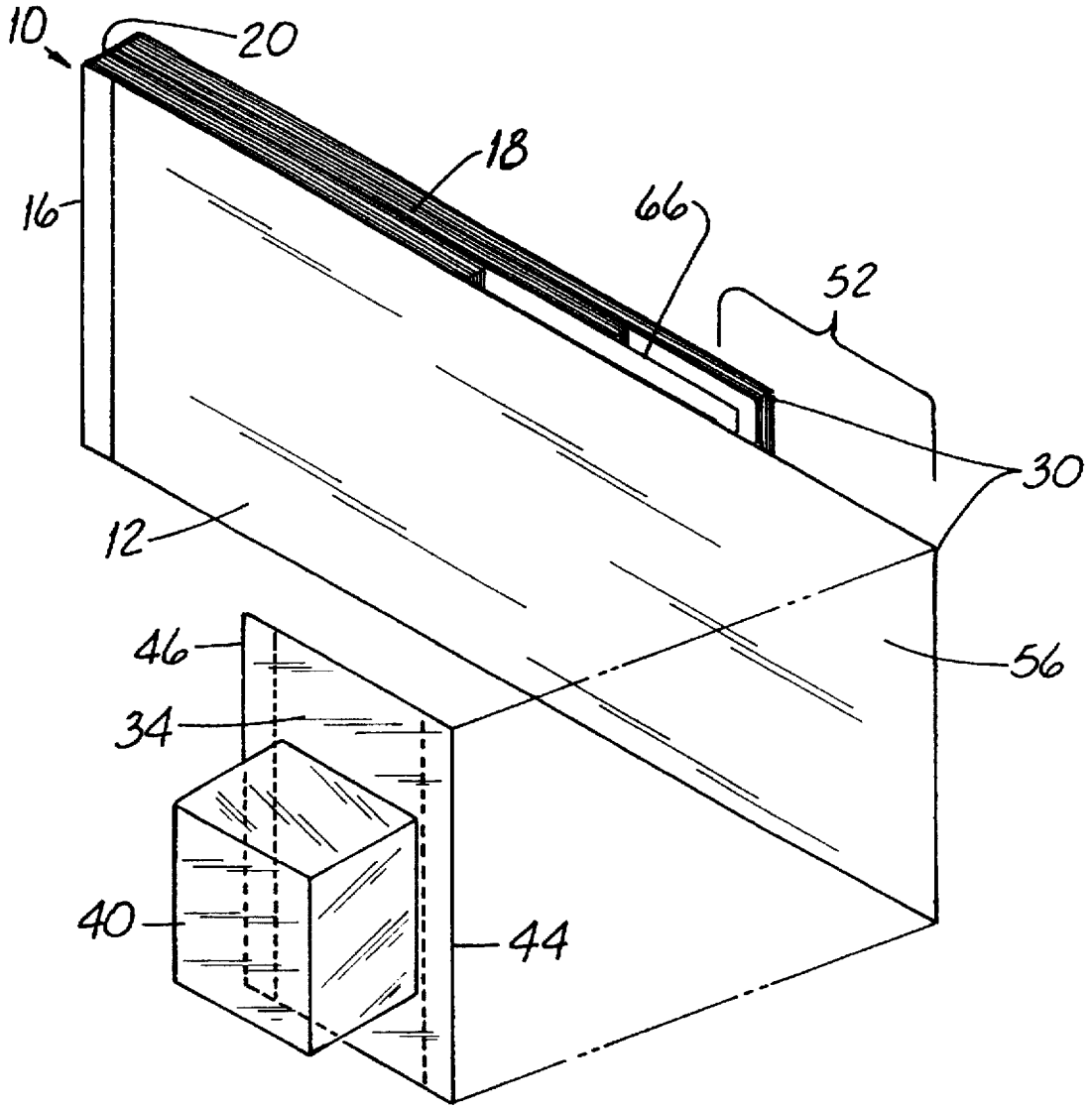
FIG. 6 is a perspective view of the photo/photo cartridge delivery/storage packet for the Advanced Photo System showing a blister member attached to the first side of the cover extension where the double-stick tape remains attached to the blister member when the blister member is removed from the cover.

As shown in FIG. 5, 6 and 19, the invention secures the APS photo cartridge 22 to the packet 10 by the use of a container member 34 and adhesive 20 between the container member 34 and the second cover member 14. In a preferred embodiment, a double-stick tape 36 is used to provide the adhesive 20, thereby facilitating attachment of the container member 34 during assembly of the packet 10. In a highly preferred embodiment, the double-stick tape 36 has adhesive of higher adhesiveness on one side 68 than on the other. This differential in adhesiveness 20 determines whether or not the double-stick tape 36 will be removed from the second cover member 14 upon removal of the container member 34 as shown in FIG. 6, or whether it will remain on the second cover member 14 as shown in FIG. 5.

Figure 18:
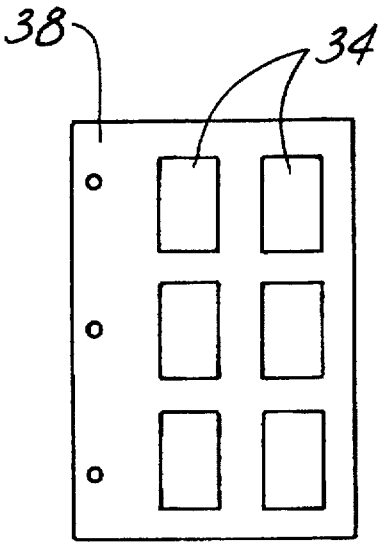
FIG. 18 is a top view of a storage sheet with blister packs attached to it.

FIG. 6, shows yet another highly preferred embodiment in which the higher-adhesiveness side 68 of the double-stick tape 36 is adhering to the container member 34, thereby facilitating removal of the container member 34 from the second cover member 14 in a manner allowing ready attachment to a storage surface 38 such as a page, either transparent or opaque, capable of being secured in a 3-ring binder, as shown in FIG. 18.

Figure 8:
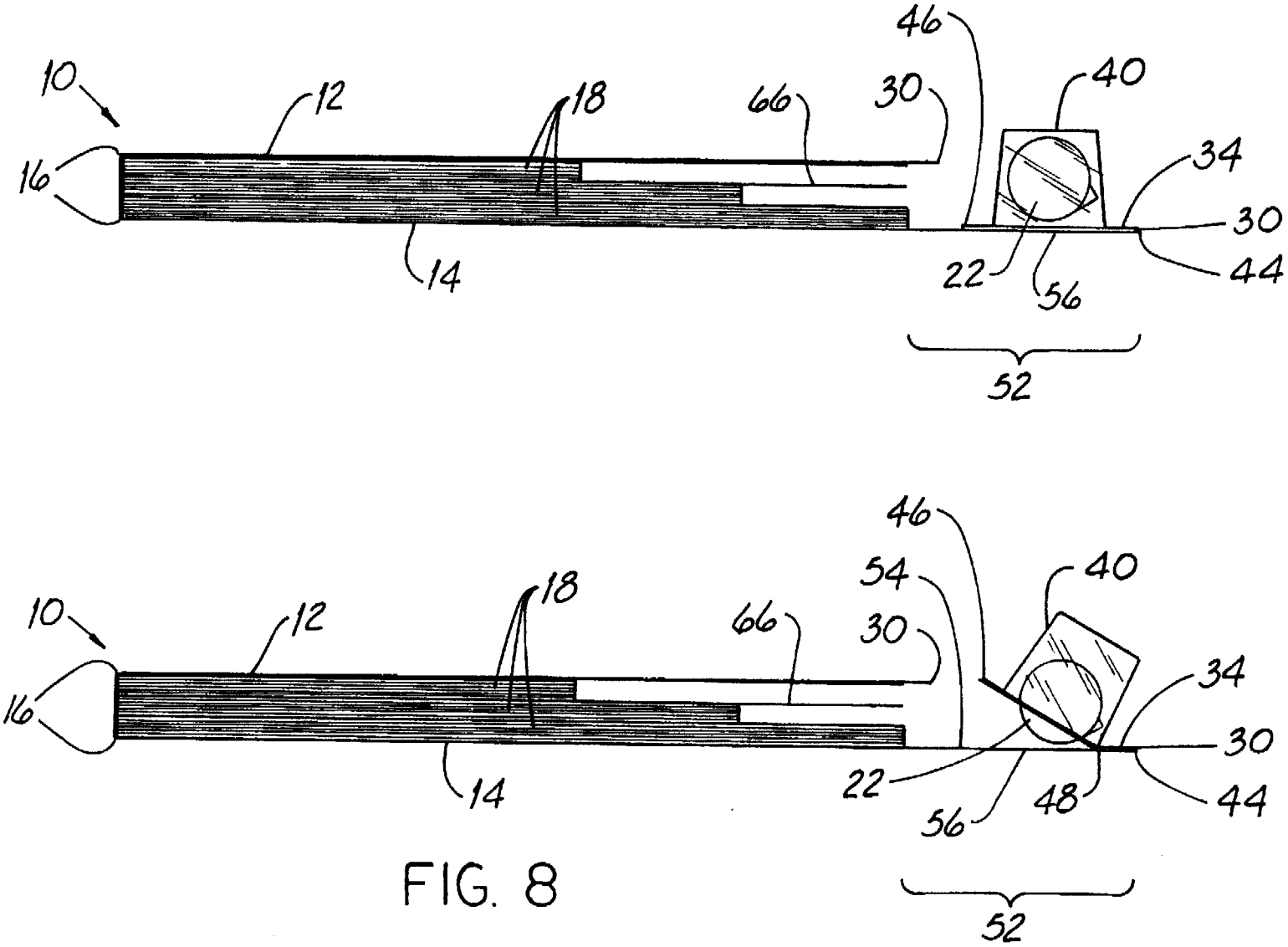
FIG. 8 is an elevation view of the photo/photo cartridge delivery/storage packet for the Advanced Photo System showing the hinge feature of the blister member.
Figure 9:
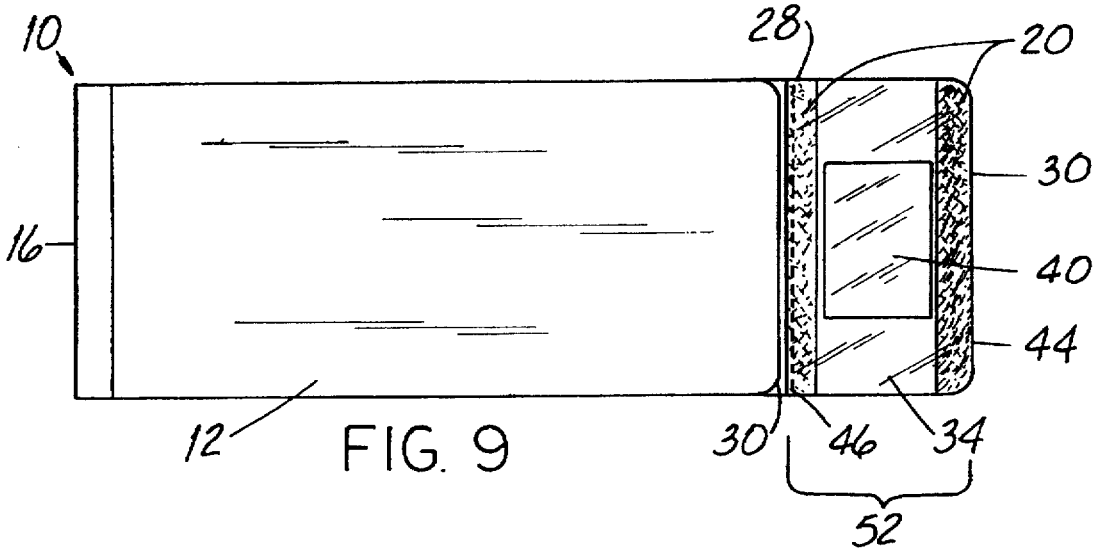
FIG. 9 is a top view of the photo/photo cartridge showing the blister member completely covering the cover delivery/storage packet for the Advanced Photo System extension.
Figure 10:
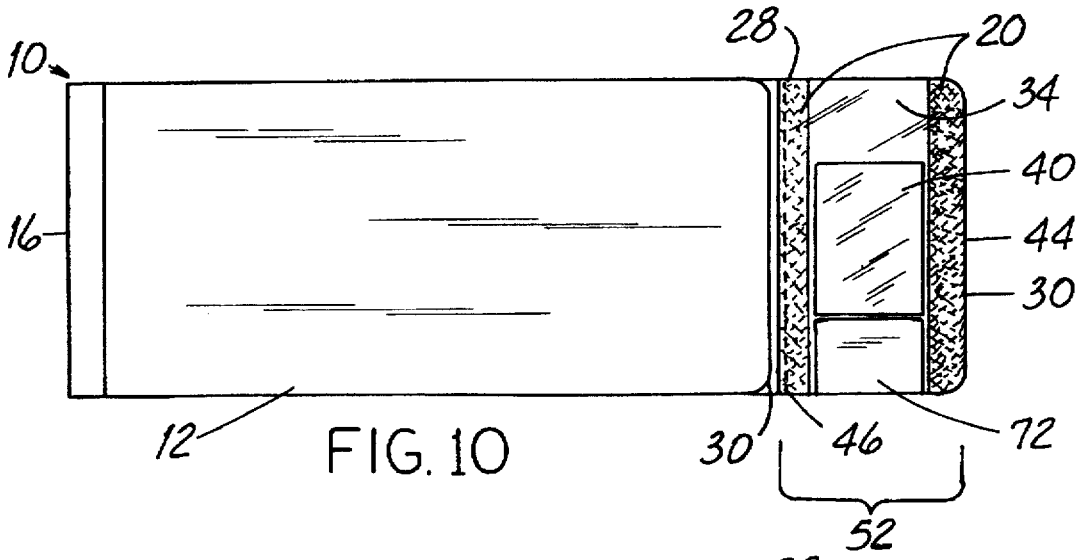
FIG. 10 is a top view of the photo/photo cartridge delivery/storage packet for the Advanced Photo System showing the blister member having a notch cut in the bottom to allow film data to be written on the cover extension.

FIGS. 1, and 3–12, show a preferred embodiment of the invention in which the container member 34 used to secure the APS photo cartridge 22 to the packet 10 comprises a blister member 40, whereby a portion of the second cover member 14 and the blister member 40 together form a blister pack 42 providing a container 34 for the cartridge. In this embodiment, the blister member 40 can fully cover the second cover member 14 or, a portion of the blister member 40 can be cut out, as shown in FIG. 10, so as to allow the user to write information concerning the subject matter of the film such as the date, time, and place of exposure on the second cover member 14.

Also in this embodiment, the blister member 40 includes opposed first and second edge portions 44, 46 which adhere to the second cover member 14. In a highly preferred embodiment, as shown in FIG. 8, the adhesive includes adhesive of higher adhesiveness along the first edge portion 44, and adhesive of lower adhesiveness along the second edge portion 46 such that the first edge portion 44 functions as a hinge 48 when only the first edge portion 44 is adhering to the second cover member 14, thereby facilitating the opening and closing of the container 34 for removal and reinsertion of the cartridge 22.

In yet another embodiment of the invention, as shown in FIG. 19, the container member 34 used to secure the APS photo cartridge 22 to the packet 10 involves the use of a pouch 50 which may be of either substantially transparent or opaque material.

FIGS. 1–11, 14, 19 and 20, show a very highly preferred embodiment of the invention, where each cover member 12, 14 has a free edge 30 opposite its spine-adjacent edge 16 and the free edge 30 of the second cover member 14 is farther from its spine-adjacent edge 16 than is the free edge 30 of the first cover member 12 from its spine-adjacent edge 16, thereby forming a cover extension 52. In this embodiment, the cover extension 52 provides the surface to which the APS photo cartridge 22 is secured by use of the various techniques described above. Also in this embodiment, the second cover 14 is scored, as described above, whereby the scored line 26 is parallel to the free edge 30 of the first cover member 12. In a specific version of this embodiment, as shown in FIG. 2, the scoring, which involves a substantially continuous partial-depth surface cutting, indentation or perforation 28, may be reinforced with double-stick tape 36. This double-stick tape 36 both reinforces the flap created by the cover extension 52 and adheres the blister bubble 40 or blister card 62 to the cover surface.

Figure 11:
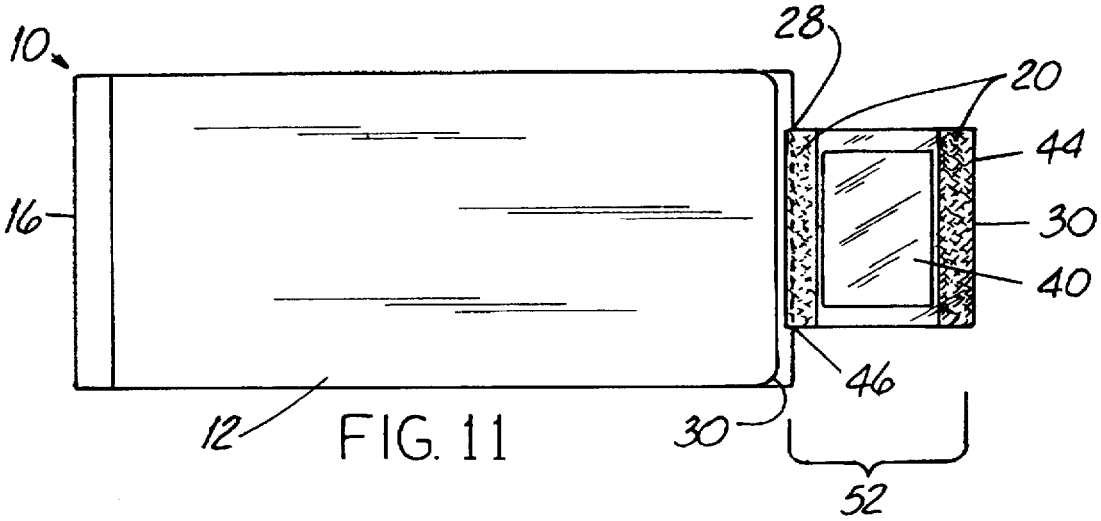
FIG. 11 is a top view of the photo/photo cartridge delivery/storage packet for the Advanced Photo System showing the blister member attached to a cover extension that is narrower than the cover member.
Figure 12:
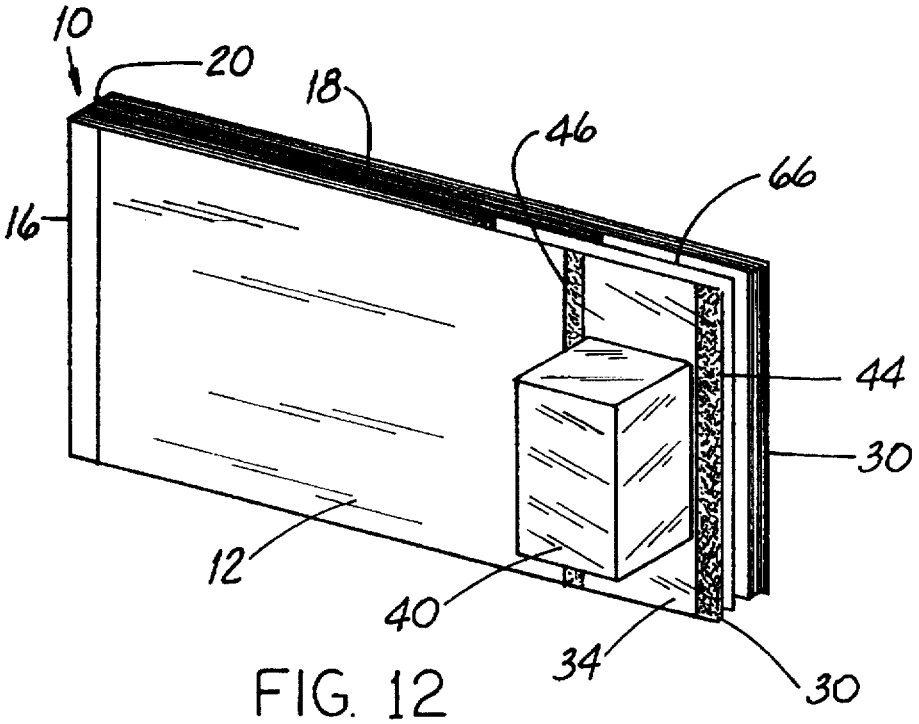
FIG. 12 is a perspective view of the photo/photo cartridge delivery/storage packet for the Advanced Photo System showing the APS film cartridge attached to the cover member.
Figure 14:
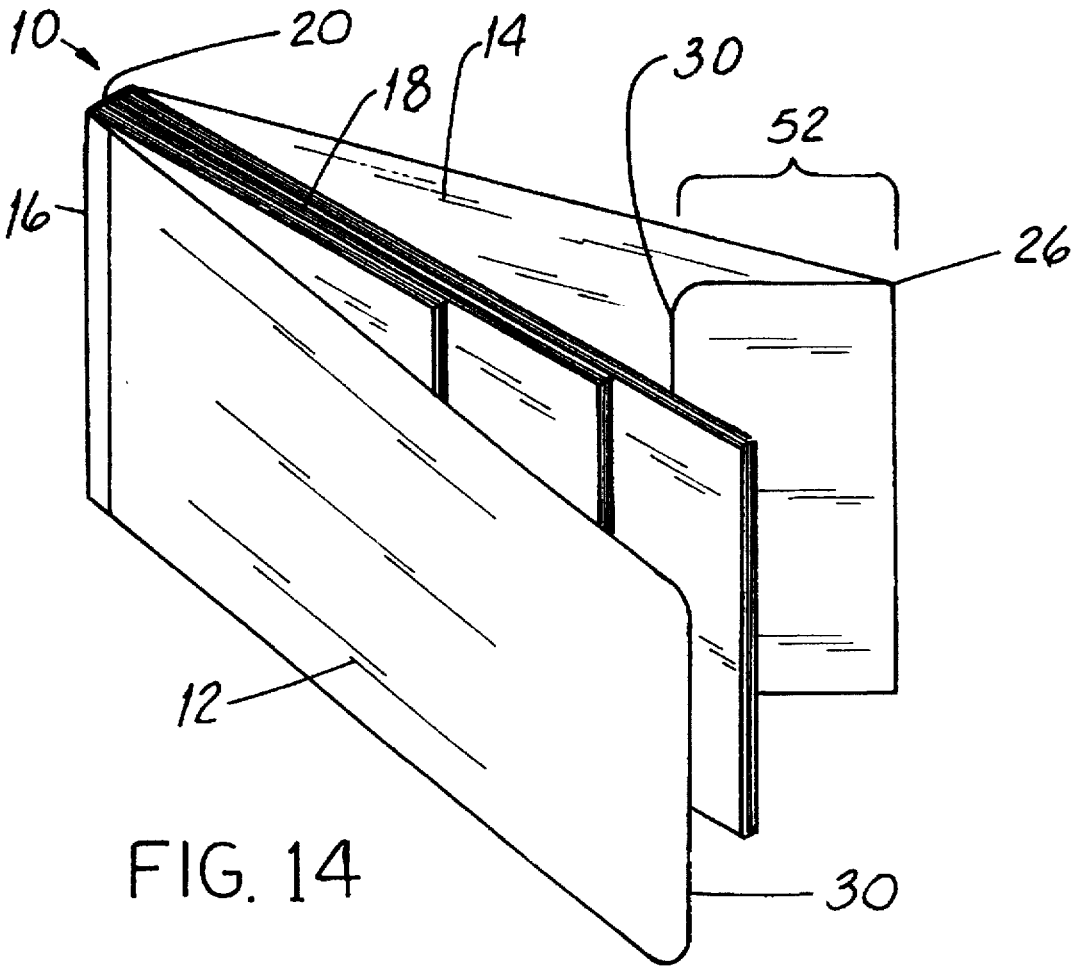
FIG. 14 is a perspective view of the photo/photo cartridge delivery/storage packet for the Advanced Photo System showing the cover extension being folded back onto the cover member.
Figure 15A:
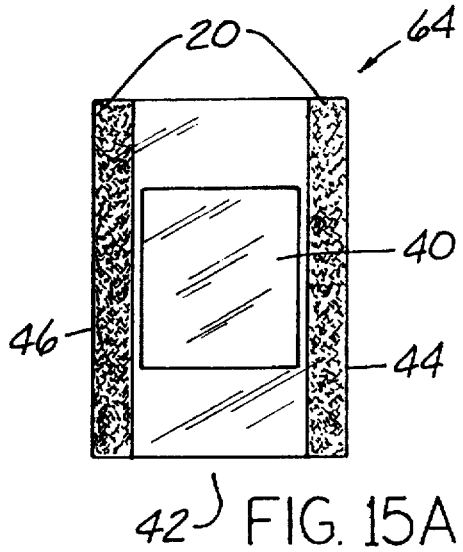
FIG. 15(A) is a top view of the blister card showing the double-stick tape between the blister member and the card member.
Figure 15B:
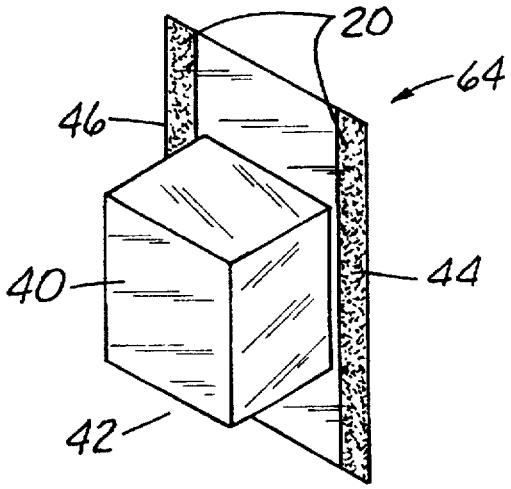
FIG. 15(B) is a perspective view of the blister card.
Figure 15C:
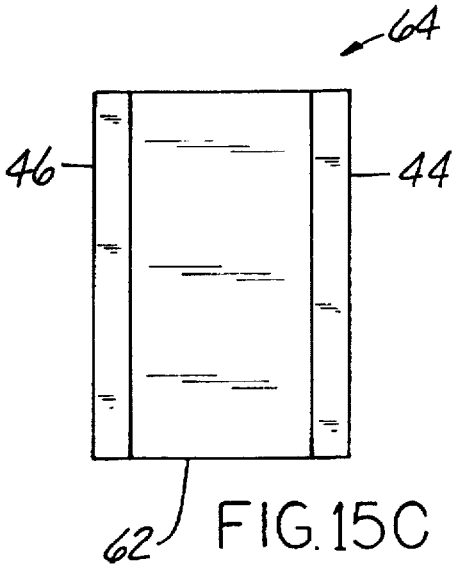
FIG. 15(C) is a back view of the blister card showing the line attached to the double-stick tape.
Figure 15D:
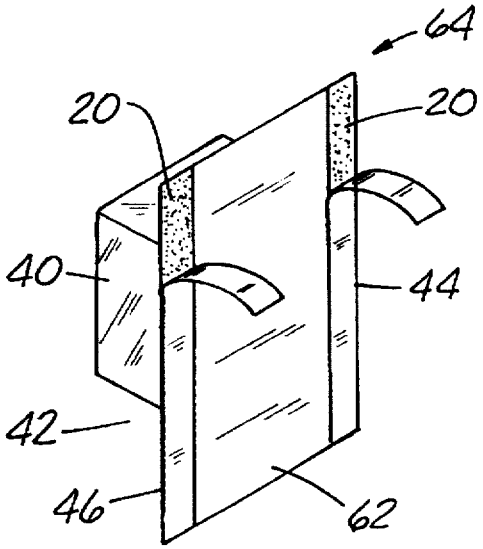
FIG.15(D) is a perspective view of the blister card showing the double-stick tape attached to the back of the card.
Figure 15E:
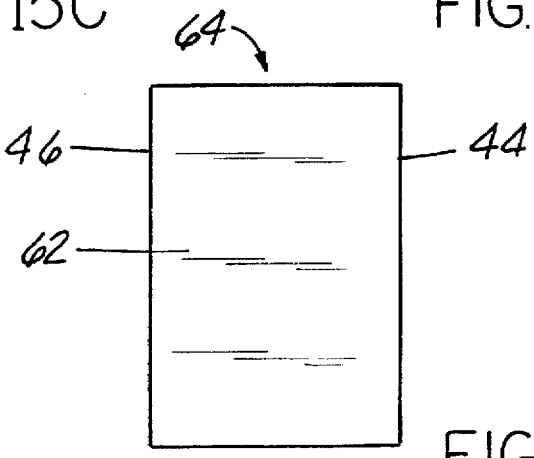
FIG. 15(E) is a top view of the blister card showing the double-stick tape between the blister member and the card member.
Figure 16:
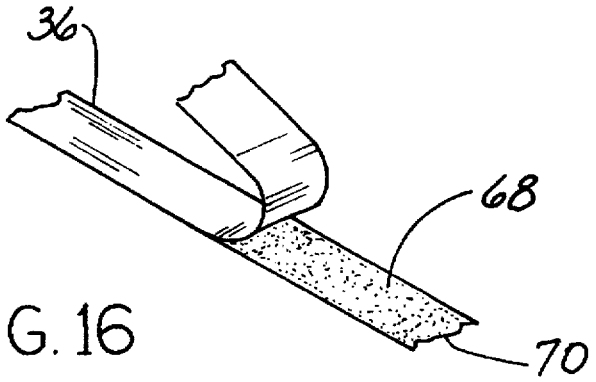
FIG. 16 is a perspective of a double-stick strip of tape.
Figure 17:
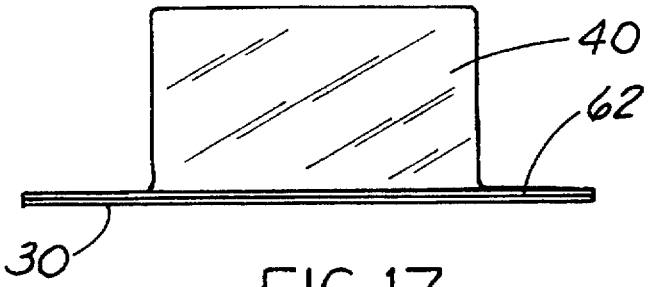
FIG. 17 is a is side elevation of the blister card showing the blister member attached to the blister card which is attached to the cover member.

In yet another highly preferred embodiment, as shown in FIG. 14, the adhesive 20 and the surfaces of the cover extension 52 and container member 34 that the adhesive 20 joins together are such that the removal of the container member 34 leaves the adhesive 20 on the cover extension 52. This allows for the cover extension 52 to be used as a flap to fold over the free edge 30 of the first cover member 12 and adhere thereto or to fold back onto and adhere to the second cover member 14. In a more specific version of such embodiment, as shown in FIGS. 4 and 11, the cover extension 52 is narrower than the remainder of the second cover member 14.

Figure 3:
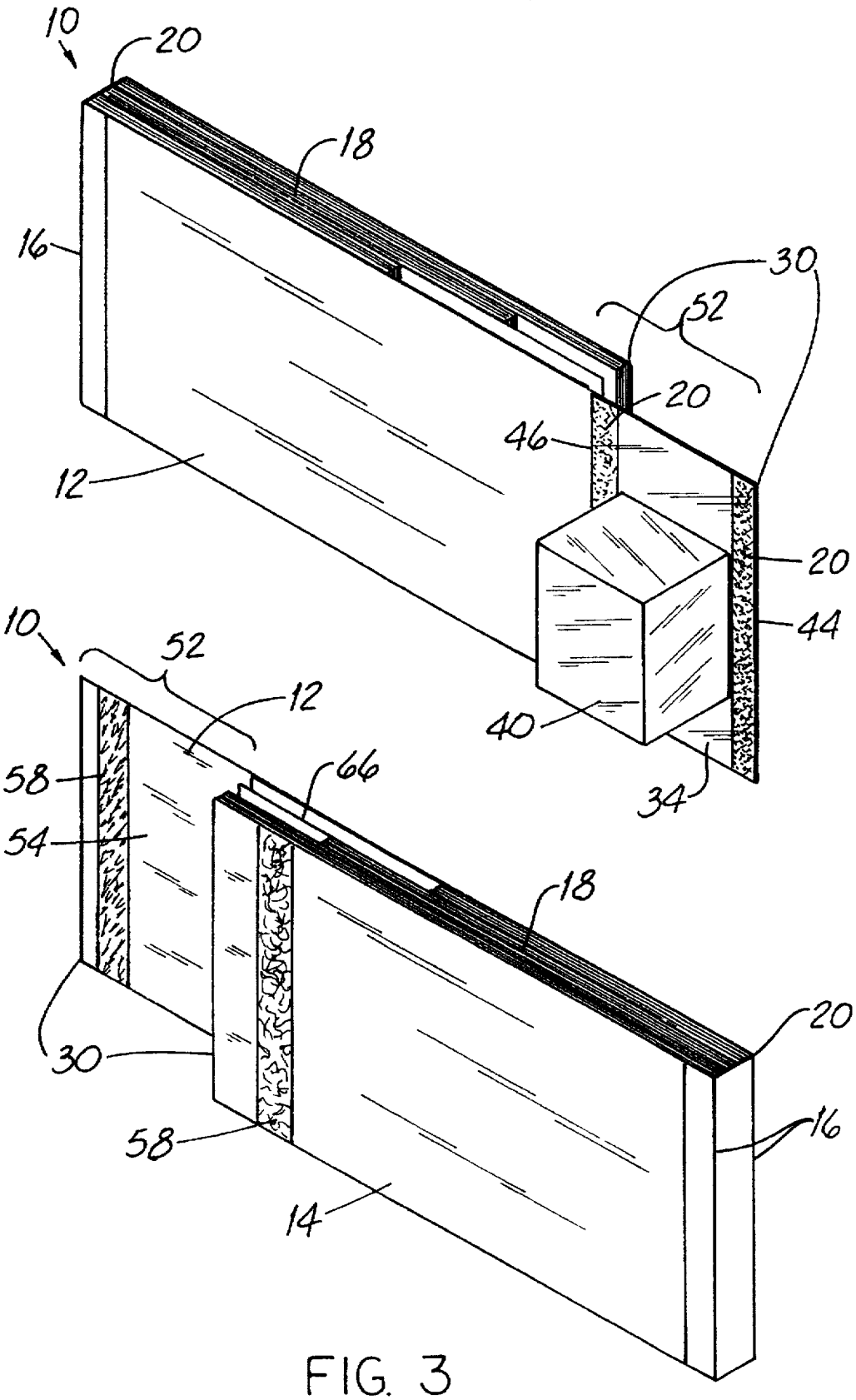
FIG. 3 is a perspective view of the photo/photo cartridge delivery/storage packet for the Advanced Photo System showing a blister member attached to the first side of the cover extension and a fastening means on the opposite side capable of locking with the fastening means on the second cover.
Figure 4:
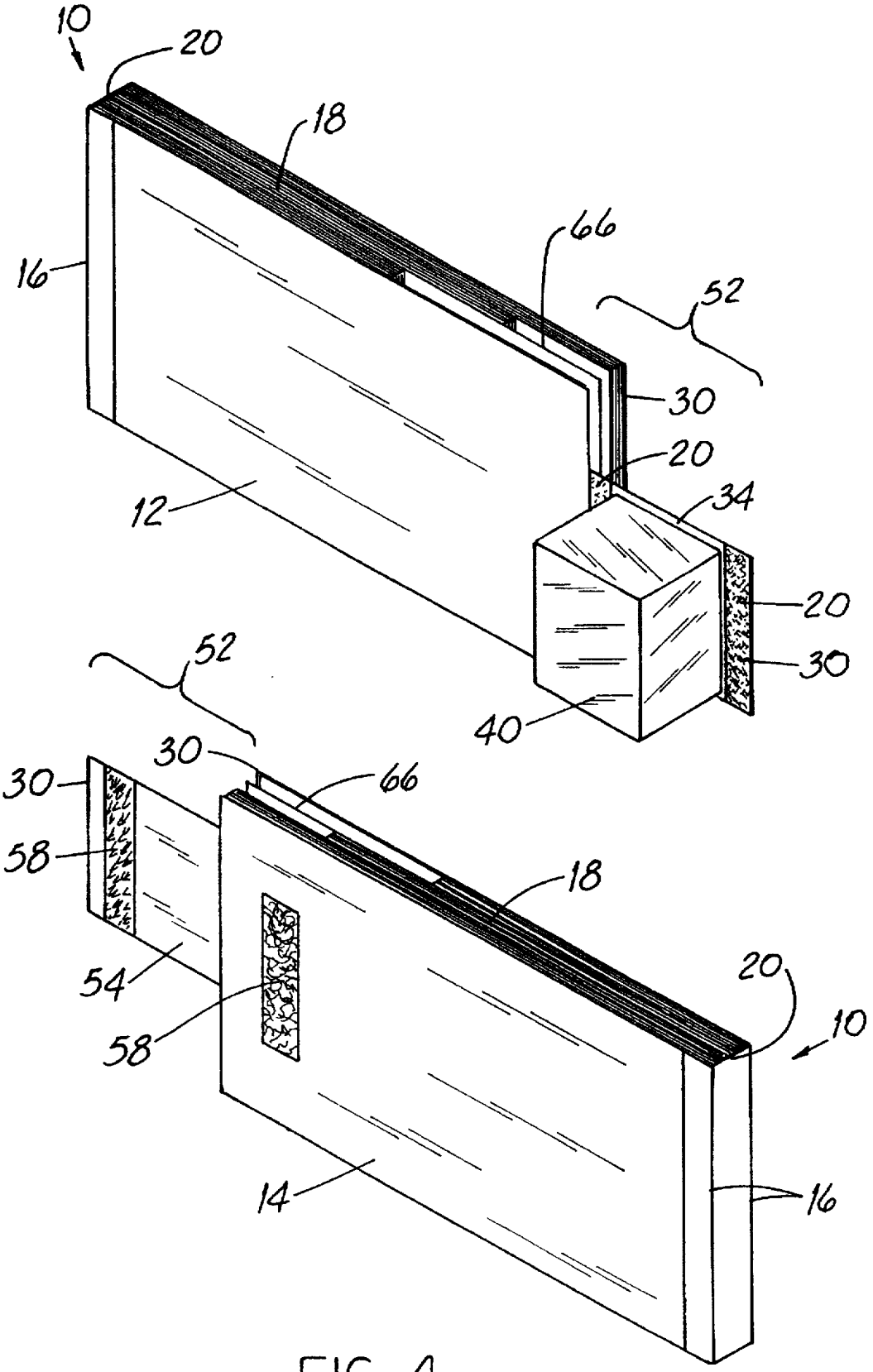
FIG. 4 is a perspective view of the photo/photo cartridge delivery/storage packet for the Advanced Photo System showing a blister member attached to the first side of the cover extension, where the cover extension is narrower than the second cover member, and a fastening means on the opposite capable of locking with the fastening means on the second cover.

FIGS. 3 and 4, show still another highly preferred embodiment of this invention where the cover extension 52 and the first cover member 12 each have an inner surface 54 and an outer surface 56, the container member 34 is secured to the outer surface 56 of the cover extension 52, and a fastening means 58 is secured to the inner surface 54 of the cover extension 52 and to the outer surface 56 of the first cover member 12 whereby the inner surface 54 of the cover extension 52 is attached against the outer surface 56 of the first cover member 12. In an additional version of this embodiment, as shown in FIG. 20, the container member 34 is secured to the inner surface 54 of the cover extension 52, and a fastening means 58 is secured to the inner surface 54 of the cover extension 52 and to the outer surface 56 of the first cover member 12.

Figure 13:
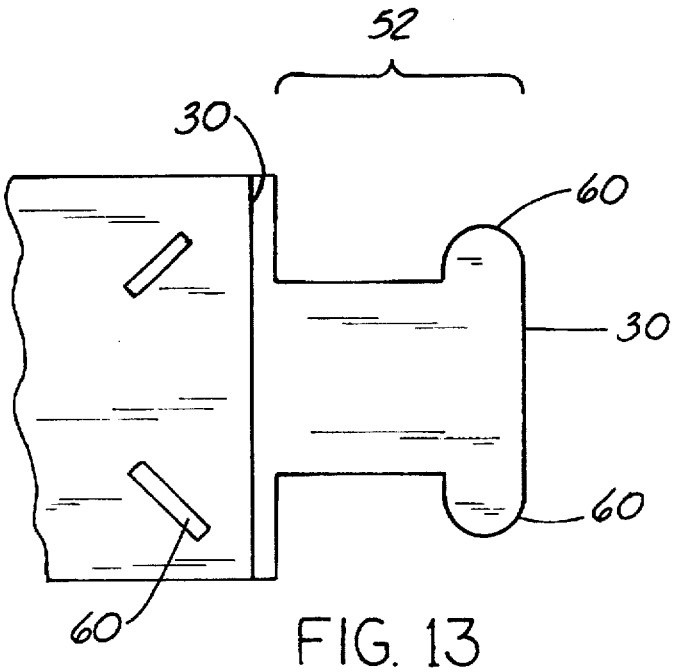
FIG. 13 is cut away view of the tab-and-slot fastening means.
Figure 20:
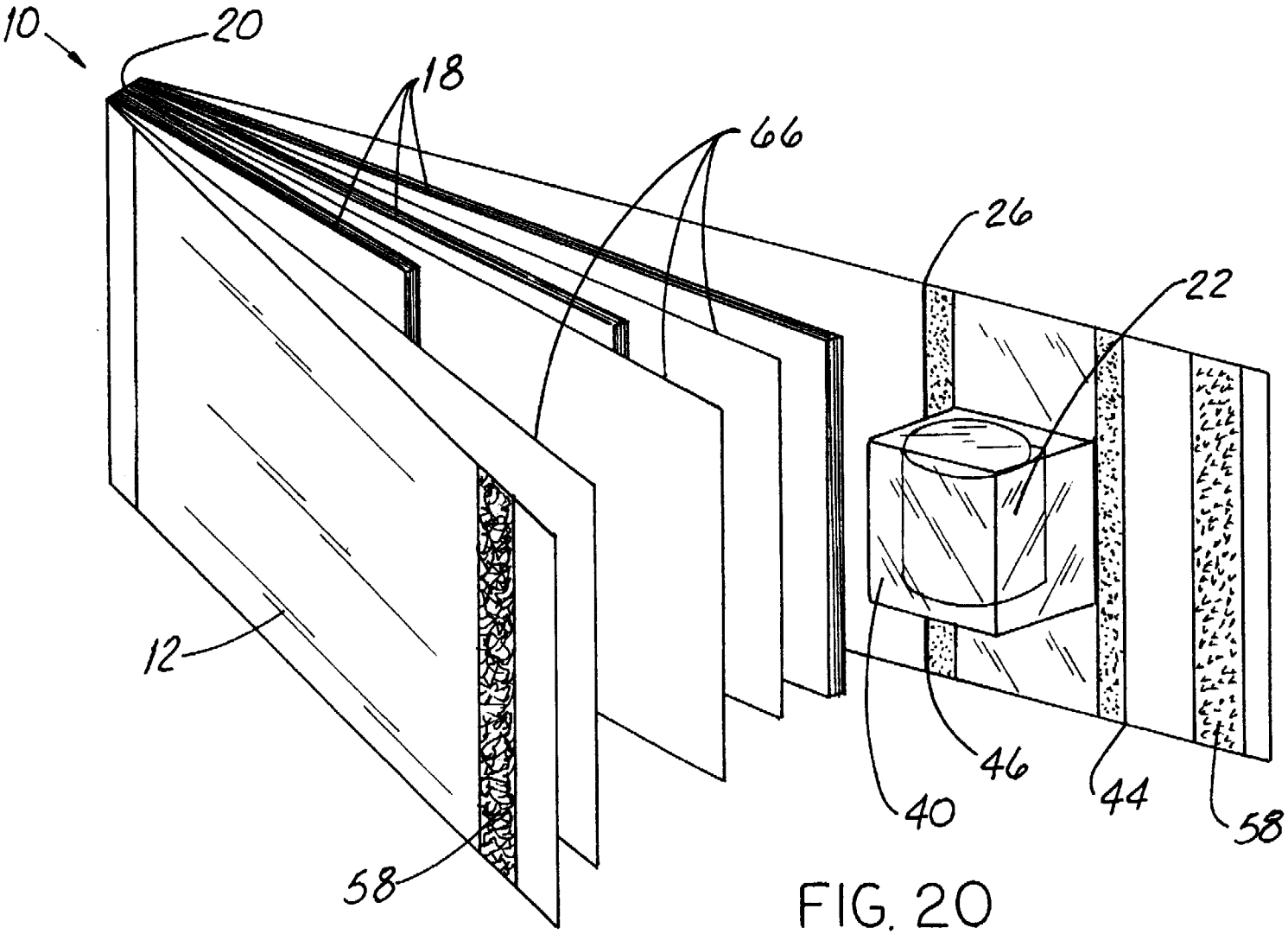
FIG. 20 is a perspective view of the photo/photo cartridge delivery/storage packet for the Advanced Photo System showing a blister member and fastening means attached to the first side of the cover extension capable of locking with the fastening means on the second cover.

In a specific version of this embodiment, the fastening means 58, shown in FIGS. 3, 4, and 20, comprise interconnecting hook and loop surfaces. In a more specific version of this embodiment, the fastening means 58 comprises double-stick tape 36. In still another version of the embodiment, the fastening means comprises magnetic tape, while in yet another version of the embodiment, the fastening means comprises an interconnecting slot-and-tab arrangement 60, as shown in FIG. 13.

FIGS. 15(*a*)–(*e*), show another version of the very highly preferred embodiment of the invention, the securing means comprises a card member 62, a container member 34 attached to the card member 62 to form a container for the cartridge 22, and an adhesive 20 between the container and the cover extension 52. In this embodiment, the adhesive 20 comprises double-stick tape 36 between the card member 62 and cover extension 52, as shown in FIG. 15(*d*) and the container member 34 comprises a blister member 40, whereby the container is a blister pack formed of the card member 62 and the blister member 34 together.

In a more specific embodiment, the blister member 34 includes opposed first and second edge 44, 46 portions which adhere to the card member 62. And, in yet another more specific embodiment, a second adhesive and a third adhesive secure the first and second edge portions 44, 46, respectively, to the card member 62. In this embodiment, the second adhesive has a higher adhesiveness than the third adhesive such that the first edge portion 44 functions as a hinge 48, as shown in FIG. 8, when only the first edge portion 44 is adhering to the card member 62, thereby facilitating opening and closing of the container for removal and reinsertion of the cartridge 22.

While the principles of the invention have been shown and described in connection with but a few embodiments, it is to be understood clearly that such embodiments are by way of example and are not limiting.

We claim:

1. A photo/photo cartridge delivery/storage packet for the products of Advanced Photo Systems (APS) processing, comprising:

first and second sheet-like cover members disposed in spaced, substantially parallel planes and each having a spine-adjacent edge;

a sheet-like spine interconnecting the cover members along said spine-adjacent edges;

a plurality of sheet-like photos interposed between the cover members and removably/replaceably secured to the spine by adhesive; and means on the second cover member for securing thereto the APS photo cartridge associated with said photos.

2. The device of claim 1 further including an APS index print and wherein the index print is attached to the inside of one of the cover members.

3. The device of claim 1 wherein the second cover member has a transverse scored line to facilitate a crease in the second cover at a distance from the spine-adjacent edge of the second cover member which is substantially equal to the distance between the spine-adjacent and free edges of the first cover member, whereby the scored line is parallel and adjacent to the free edge of the first cover member.

4. The device of claim 3 wherein the scored line is a perforation.

5. The device of claim 1 wherein the second cover member includes an opening to facilitate hanging of the device on a rod.

6. The device of claim 1 wherein the securing means comprises:

a container member; and adhesive between the container member and the second cover member.

7. The device of claim 6 further including double-stick tape which provides the adhesive, thereby facilitating attachment of the container member during assembly of the packet.

8. The device of claim 7 wherein the double-stick tape has adhesive of higher adhesiveness on one side than on the other, thereby determining whether or not the double-stick tape will be removed from the second cover member upon removal of the container member.

9. The device of claim 8 wherein the higher-adhesiveness side of the double-stick tape is adhering to the container member, thereby facilitating removal of the container member from the second cover member in a manner allow ready attachment to a storage surface.

10. The device of claim 6 wherein the container member comprises a blister member, whereby a portion of the second cover member and the blister member together form a blister pack providing a container for the cartridge.

11. The device of claim 10 wherein the blister member includes opposed first and second edge portions adhering to the second cover member.

12. The device of claim 11 wherein the adhesive includes adhesive of higher adhesiveness along the first edge portion such that the first edge portion functions as a hinge when only the first edge portion is adhering to the second cover member, thereby facilitating opening and closing of the container for removal and reinsertion of the cartridge.

13. The device of claim 6 wherein the securing means comprises a pouch.

14. The device of claim 13 wherein the pouch is of a substantially transparent material.

15. The device of claim 1 wherein each cover member has a free edge opposite its spine-adjacent edge and the free edge of the second cover member is farther from its spine-adjacent edge than is the free edge of the first cover member from its spine-adjacent edge, thereby forming a cover extension.

16. The device of claim 15 further including an APS index print and wherein the index print is attached to the inside of one of the cover members.

17. The device of claim 15 wherein the second cover member has a transverse scored line to facilitate a crease in the second cover at a distance from the spine-adjacent edge of the second cover member which is substantially equal to the distance between the spine-adjacent and free edges of the first cover member, whereby the scored line is parallel and adjacent to the free edge of the first cover member and defines the cover extension.

18. The device of claim 17 wherein the scored line is a perforation.

19. The device of claim 18 further including double-stick tape which provides the adhesive, at least a portion of the double-stick tape extending over the perforation line, thereby reinforcing the perforation.

20. The device of claim 15 wherein the second cover member includes an opening to facilitate hanging of the device on a rod.

21. The device of claim 15 wherein the securing means comprises:

a container member; and adhesive between the container member and the cover extension.

22. The device of claim 21 wherein the container member comprises a blister member, whereby a portion of the cover extension and the blister member together form a blister pack providing a container for the cartridge.

23. The device of claim 22 wherein the blister member includes opposed first and second edge portions adhering to the cover extension.

24. The device of claim 23 wherein the adhesive includes adhesive of higher adhesiveness along the first edge portion such that the first edge portion functions as a hinge when only the first edge portion is adhering to the cover extension, thereby facilitating opening and closing of the container for removal and reinsertion of the cartridge.

25. The device of claim 21 wherein the securing means comprises a pouch.

26. The device of claim 25 wherein the pouch is of a substantially transparent material.

27. The device of claim 21 further including double-stick tape which provides the adhesive, thereby facilitating attachment of the container member during assembly of the packet.

28. The device of claim 27 wherein the double-stick tape has adhesive of higher adhesiveness on one side than on the other, thereby determining whether or not the double-stick tape will be removed from the cover extension upon removal of the container member.

29. The device of claim 28 wherein the higher-adhesiveness side of the double-stick tape is adhering to the container member, thereby facilitating removal of the container member from the cover extension in a manner allow ready attachment to a storage surface.

30. The device of claim 21 wherein the adhesive and surfaces of the cover extension and container member which such adhesive joins are such that removal of the container member leaves the adhesive on the cover extension, thereby facilitating use of the cover extension as a flap to fold over the free edge of the first cover member and adhere thereto or to fold back onto and adhere to the second cover member.

31. The device of claim 15 wherein the cover extension is narrower than the remainder of the second cover member.

32. The device of claim 21 wherein:

the cover extension and the first cover member each have an inner surface and an outer surface;

the container member is secured to the outer surface of the cover extension; and fastening means is secured to the inner surface of the cover extension and to the outer surface of the first cover member;

whereby the inner surface of the cover extension is attached against the outer surface of the first cover member.

33. The device of claim 32 wherein the fastening means comprises interconnecting hook and loop surfaces.

34. The device of claim 32 wherein the fastening means comprises double-stick tape.

35. The device of claim 32 wherein the fastening means comprises magnetic tape.

36. The device of claim 32 wherein the fastening means comprises an interconnecting slot-and-tab arrangement.

37. The device of claim 21 wherein:

the cover extension and the first cover member each have an inner surface and an outer surface;

the container member is secured to the inner surface of the cover extension; and fastening means is secured to the inner surface of the cover extension and to the outer surface of the first cover member;

whereby upon removal of the container member the inner surface of the cover extension is attached against the outer surface of the first cover member.

38. The device of claim 37 wherein the fastening means comprises interconnecting hook and loop surfaces.

39. The device of claim 37 wherein the fastening means comprises double-stick tape.

40. The device of claim 37 wherein the fastening means comprises magnetic tape.

41. The device of claim 37 wherein the fastening means comprises an interconnecting slot-and-tab arrangement.

42. The device of claim 15 wherein the securing means comprises:

a card member;

a container member attached to the card member to form a container for the cartridge; and adhesive between the container and the cover extension.

43. The device of claim 42 wherein the adhesive comprises double-stick tape between the card member and cover extension.

44. The device of claim 42 wherein the container member comprises a blister member, whereby the container is a blister pack formed of the card member and the blister member together.

45. The device of claim 44 wherein the blister member includes opposed first and second edge portions adhering to the card member.

46. The device of claim 45 wherein a second adhesive and a third adhesive secure the first and second edge portions, respectively, to the card member, the second adhesive having a higher adhesiveness than the third adhesive such that the first edge portion functions as a hinge when only the first edge portion is adhering to the card member, thereby facilitating opening and closing of the container for removal and reinsertion of the cartridge.

* * * * *

UNITED STATES PATENT AND TRADEMARK OFFICE

CERTIFICATE OF CORRECTION

PATENT NO. : 5,704,472

DATED : January 6, 1998

INVENTOR(S) : Richard S. Werner, Al Sitter and Steve Kruchten

It is certified that error appears in the above-identified patent and that said Letters Patent is hereby corrected as shown below:

In column 5, line 4, after "opposite" insert --side--.

In column 5, delete lines 26-28 and insert --FIGURE 9 is a top view of the photo/photo cartridge delivery/storage packet for the Advanced Photo System showing the blister member completely covering the cover extension.--

In column 5, line 53, delete "line" and insert --liner--.

Signed and Sealed this

Fifth Day of May, 1998

Bruce Lehman

*Attest:*

BRUCE LEHMAN

*Attesting Officer*

*Commissioner of Patents and Trademarks*